US005588458A

United States Patent [19]

Ushitora et al.

[11] Patent Number: 5,588,458

[45] Date of Patent: Dec. 31, 1996

[54] VACUUM VALVE CONTROLLER FOR VACUUM SEWER SYSTEM

[75] Inventors: Akihiro Ushitora; Osamu Shimizu, both of Kanagawa-ken, Japan

[73] Assignee: Ebara Corporation, Tokyo, Japan

[21] Appl. No.: 417,764

[22] Filed: Apr. 6, 1995

[30] Foreign Application Priority Data

Apr. 19, 1994 [JP] Japan ..... 6-104587
Feb. 2, 1995 [JP] Japan ..... 7-039362

[51] Int. Cl.[6] ..... E03C 1/12

[52] U.S. Cl. ..... 137/205; 137/236.1; 137/396; 137/403; 137/907

[58] Field of Search ..... 4/323; 137/205, 137/236.1, 396, 403, 907

[56] References Cited

U.S. PATENT DOCUMENTS 3,774,637 11/1973 Weber et al. .
3,777,778 12/1973 Janu .
4,373,837 2/1983 Lin et al. .
4,373,838 2/1983 Foreman et al. ..... 137/236.1 X
4,603,709 8/1986 Huisma ..... 137/205
4,691,731 9/1987 Grooms et al. ..... 137/205
5,069,243 12/1991 Foreman ..... 137/205
5,114,280 5/1992 Ushitora et al. ..... 137/236.1 X

FOREIGN PATENT DOCUMENTS 6-2777 1/1994 Japan .
6-117013 4/1994 Japan .
2149534 6/1985 United Kingdom .

*Primary Examiner*—Gerald A. Michalsky
*Attorney, Agent, or Firm*—Armstrong, Westerman, Hattori, McLeland & Naughton

[57] ABSTRACT

A vacuum valve controller for a vacuum sewer system including a suction pipe (12) which is communicated with a vacuum system (15) by opening a vacuum valve (14), and which is cut off from the vacuum system by closing the vacuum valve (14) is disclosed. Soil water in a soil water basin (10) is sucked through the suction pipe (12) and sent to a predetermined place by opening the vacuum valve (14). The vacuum valve controller is provided with a control device (20) which closes the vacuum valve (14) by detecting that the suction pipe has begun to suck air from a change of the pressure difference between two points (16 and 17) in the suction pipe (12) which are different in height from each other, which provide a vacuum valve controller for a vacuum sewer system, which is simple in structure, easy to maintain and capable of stable operation.

11 Claims, 5 Drawing Sheets

VACUUM VALVE CONTROLLER FOR VACUUM SEWER SYSTEM

BACKGROUND OF THE INVENTION

1. Field of the Art

The present invention relates to a vacuum valve controller for a vacuum sewer system in which soil water in a soil water basin is sucked through a suction pipe by opening a vacuum valve and sent to a predetermined place, e.g., a sewage disposal plant.

2. Prior Art

FIG. 5 shows one example of the arrangement of a conventional vacuum sewer system of the type described above. In the figure, reference numeral 10 denotes a soil water basin. One end of a suction pipe 12 is inserted into the soil water basin 10. The other, or rear, end of the suction pipe 12 is connected to a line 15 which communicates with a vacuum tank (vacuum system not shown) through a main valve 14 of a vacuum valve. A vacuum valve body 13 has in a chamber 13*c* a diaphragm 13*b* and a spring 13*a* for biasing the diaphragm 13*b* into a valve closing position.

Reference numeral 200 denotes a controller for on/off controlling the vacuum valve. The controller 200 has a cylindrical casing 201. The inside of the casing 201 is divided into a sensor chamber 202, a first chamber 203, a second chamber 204, a third chamber 205, a fourth chamber 206, and a fifth chamber 207. The sensor chamber 202 is connected to a pressure sensor pipe 11, which is disposed in the soil water basin 10 through a pipe 208. The fifth chamber 207 is connected to an actuating chamber 13*c* in the vacuum valve body 13 through a pipe 209. Further, the fifth chamber 207 communicates with the outside air through a breather pipe 210.

The fourth chamber 206 is connected to the line 15 through a pipe 211 and a check valve 212. The first chamber 203 is connected to the breather pipe 210 through a filter 213 and a check valve 214 with an orifice. The second and third chambers 204 and 205 are connected to each other by a pipe 216 through a needle valve 215. The distal end of the pipe 216 is connected to the fourth chamber 206 through a bevel check valve 217.

In the vacuum sewer system arranged as shown in FIG. 5, when the level of soil water Q in the soil water basin 10 is low, and consequently the system is in a stand-by position, the lower end of the pressure sensor pipe 11 lies above the soil water surface. Therefore, the sensor chamber 202 and the first chamber 203 are placed under the atmospheric pressure, and the sensor diaphragm 218 is in a neutral position. Accordingly, the sensor lever 220 closes the air passage 223 by the action of the vacuum in the second chamber 204 and the force of a spring 219, and thus no air flows through the air passage. The vacuum in the pipe 15 is coupled to the third chamber 205 and second chamber 204 through the needle valve 215. Therefore, the two chambers 204 and 205 are placed under the same vacuum. Accordingly, a three-way valve 222 is held in the leftward position by the biasing force of a spring 221. Since the fifth chamber 207 communicates with the atmospheric air through the breather pipe 210, the chamber 13*c* in the vacuum valve body 13 is placed under the atmospheric pressure. Accordingly, the main valve 14 is pressed in the direction for closing the valve by the spring 13*a* and thus set in a full-closed state.

As the level of soil water in the soil water basin 10 rises, the pressure detected by the pressure sensor pipe 11 rises. Consequently, the sensor diaphragm 218 moves right-ward and comes in contact with the sensor lever 220. When the pressure exceeds a water column of about 20 mmAq, it overcomes the sum of the force of the spring 219 and the vacuum in the second chamber 204 and causes the sensor lever 220 to separate from the air passage 223. Thus, the air in the first chamber 203 flows into the second chamber 204 through the air passage 223, causing the pressure in the second chamber 204 to rise to a level higher than the pressure in the third chamber 205. When the pressure in the second chamber 204 becomes stronger than the force of the spring 221, a three-way valve driving diaphragm 222*a* moves rightward, causing the three-way valve 222 to close a hole which communicates with the breather pipe 210. Accordingly, the vacuum in the line 15 is coupled to the chamber 13*c* in the vacuum valve body 13 through the fourth chamber 206, the axial passage in the three-way valve 222, the fifth chamber 207 and the pipe 209. Thus, the vacuum in the chamber 13*c* overcomes the force of the spring 13*a* and raises the main valve 14 from its valve seat, thereby setting the vacuum valve in a fully-open state (i.e., a state where the bore that provides communication between the suction pipe 12 and the line 15 is open).

When the vacuum valve is set in the fully-open state, soil water in the soil water basin 10 is sucked up, and the soil water level begins to fall. The pressure detected by the pressure sensor 11 immediately drops, and consequently the sensor diaphragm 218 moves leftward, thereby allowing the sensor lever 220 to return to the previous position to close the air passage 223. The drop of the vacuum in the line 15 causes the bevel check valve 217 close. Consequently, the second and third chambers 204 and 205 gradually approach the same vacuum through the needle valve 215. As a result, the force of the spring 221 in the third chamber 205 overcomes the pressure in the second chamber 204 and thus causes the three-way valve 222 to move leftward and return to the previous position. Thus, the outside air flows into the fifth chamber 207 through the breather pipe 210, and the air flows into the chamber 13*c* in the vacuum valve body 13 through the pipe 209, causing the main valve 14 to be closed.

The controller 200, arranged as described above, however, suffers from the following problems:

(1) When the level of soil water Q in the soil water basin 10 falls as a result of suction carried out with the vacuum valve open, the sensor lever 220 closes the air passage 223. The length of time from the instant the air passage 223 is closed by the sensor lever 220 until the second and third chambers 204 and 205 reach the same vacuum, and consequently the main valve 14 is closed, depends on the initial pressure difference between the second and third chambers 204 and 205. Since the pressure in the second chamber 204 is equal to the atmospheric pressure and hence constant, the above-described time depends on the degree of vacuum in the third chamber 205. Consequently, when the degree of vacuum in the third chamber 205 is high, the period of time during which the vacuum valve is open is relatively long; while when the degree of vacuum is low, the period of time is relatively short. That is, when the degree of vacuum in the line 15 is high, the period of time during which the vacuum valve is open is relatively long, and the suction force is also relatively strong. Therefore, a relatively large amount of air is sucked. Conversely, when the degree of vacuum in the line 15 is low, the period of time during which the vacuum valve is open is relatively short, and the suction force is also relatively weak. Accordingly, substantially no air is sucked in.

(2) The gas-liquid ratio, i.e., the proportions in which air and soil water are sucked through the suction pipe 12, depends on the degree of vacuum. That is, when the degree of vacuum is high, the gas-liquid ratio is high; whilst when the degree of vacuum is low, the gas-liquid ratio is low.

(3) When the degree of vacuum is low, the main valve 14 is closed with substantially no air being sucked. Therefore, an air lock is likely to occur in the piping (mainly the line).

(4) Since the control of the gas-liquid ratio is effected by the needle valve 215, which is very small in size, water droplets may close the needle valve 215. If the needle valve 215 is closed by water droplets, the second and third chambers 204 and 205 will not readily reach the same vacuum, and consequently the main valve 14 will not readily be closed.

(5) The controller 200 is installed within an upper space of the soil water basin 10 and, therefore, it must be sealed against entering of the soil water therein. However, the hole communicated with the breather pipe 210 is not positively closed by the three-way valve 222 even when the soil water level in the soil water basin is high.

Thus, basically, the breather pipe 210 must be installed outdoors in order to prevent water or any other liquid from entering the casing of the controller 200.

(6) For a vacuum valve which is disposed close to a vacuum pump station, the gas-liquid ratio should preferably be minimized. However, it is difficult to reduce the gas-liquid ratio when the degree of vacuum is in the ordinary vacuum range of from −0.3 to −0.7 kg/cm$^2$. That is, since more air is sucked than is needed, the load on the vacuum pump is greatly increased.

(7) The conventional controller requires a large number of components, i.e., a needle valve, a sensor lever and other elements, and has a complicated structure. Therefore, a great deal of time is required for maintenance.

(8) Since a vacuum is used for activating, the operation of the controller and the vacuum valve may become unstable on account of variation in the degree of vacuum.

In view of the above-described circumstances, it is an object of the present invention to provide a vacuum valve controller for a vacuum sewer system, which is free from the above-described disadvantages and which is capable of stably operating with a simplified structure.

SUMMARY OF THE INVENTION

To solve the above-described problems, the present invention provides a vacuum valve controller for a vacuum sewer system having a suction pipe which is communicated with a vacuum system by opening a vacuum valve, and which is cut off from the vacuum system by closing the vacuum valve, so that soil water in a soil water basin is sucked through the suction pipe and sent to a predetermined place by opening the vacuum valve. The vacuum valve controller is characterized by comprising a device for detecting a soil water level when the suction pipe begins to suck air from a lower end thereof when the soil water level has fallen as a result of suction of soil water through the suction pipe, and a control device for closing the vacuum valve when the detecting device detects that the suction pipe has begun to suck air through the suction pipe.

The vacuum valve controller is further characterized in that the detection device detects that the suction pipe begins to suck air from a change of pressure difference between two points in the suction pipe which are different in height from each other.

Further, the vacuum valve controller is characterized in that the controller includes a pressure sensor pipe for converting the rising of the soil water within the soil water basin into a pressure and transmitting the pressure to the control device, and the control device opens the vacuum valve by means of the pressure when the soil water level within the soil water basin reaches a predetermined value.

The vacuum valve controller is also characterized in that the pressure difference between the two points in the suction pipe is transmitted to the control device and the control device holds the vacuum valve being open by means of the pressure difference applied thereto.

The vacuum valve controller is further characterized in that the controller includes a vacuum valve on/off control mechanism for opening and closing the vacuum valve, the vacuum valve on/off control mechanism includes a shaft reciprocably provided within a casing and a valve body provided on the shaft, the valve body is shiftable between a first position where an actuating chamber of the vacuum valve is communicated with a line of the vacuum system for opening the vacuum valve and a second position where the actuating chamber is opened to atmospheric air for closing the vacuum valve.

In addition, the vacuum valve controller is characterized in that the control device comprises a vacuum valve on/off control mechanism for opening and closing the vacuum valve, a reciprocating shaft for operating the vacuum valve on/off control mechanism, first and second diaphragms attached to the shaft, a spring means for biasing the shaft in the normal direction for closing the vacuum valve, a pair of pressurized chambers for applying pressure on both sides of the first diaphragm, a pressurized chamber for applying a pressure on one side of the second diaphragm to thereby shift the shaft in a direction for opening the vacuum valve, and a pressure sensor pipe for converting the rise of the soil water level in the soil water basin into a pressure. A soil water pressure at two points different in height of the suction pipe is transmitted to the pressurized chambers on both sides of the first diaphragm so that a pressure difference therebetween operates to shift the shaft in a direction for opening the valve against the spring means, and a pressure generated in the pressure sensor pipe is transmitted to the pressurized chamber on one side of the second diaphragm.

Further, the vacuum valve controller is characterized in that fluid restrictions are provided in respective pipes connecting the control device and the suction pipe for transmitting the soil water pressure to the pressurized chambers on both sides of the first diaphragm, whereby reciprocating of the shaft within a short period due to temporal fluctuation of the pressure difference between the two different points in the suction pipe is prevented and the movement of the first diaphragm is delayed to control the volume of suction air through the vacuum valve.

The vacuum valve controller is further characterized in that a magnet is provided for attracting the shaft in a direction in which the vacuum valve is closed.

With the above-described arrangement, the vacuum valve is closed after detecting that the suction pipe begins to suck air. Accordingly, the present invention is free from the problem that the amount of air sucked varies according to the degree of vacuum. Also, the present invention is free from the problems associated with the conventional controller that air lock occurs in the piping, since air is positively sucked in the suction pipe even if the degree of vacuum is low.

Further, since no vacuum is used as force for activating the vacuum valve controller, the operation is independent of the degree of vacuum and hence stabilized. In addition, no breather pipe is needed, because the control device for on/off controlling the vacuum valve is so designed that it positively seals an air introducing hole when the soil water level in the soil water basin rises so that there is no possibility that the soil water could enter the control device.

The pressure difference between two points in the suction pipe which are different in height from each other is large during the suction of soil water, but it is small during the suction of air. Accordingly, it is possible to detect the fact that the suction pipe begins to suck air, from a point at which the pressure difference rapidly decreases.

In addition, fluid restrictions are provided in respective pipes for transmitting a soil water pressure in the suction pipe to the pressurized chambers on both sides of the first diaphragm to prevent movement of the shaft within a short period due to the temporal fluctuation of the pressure difference between the two points in the suction pipe which are different in height and also delay the movement of the first diaphragm thereby controlling the volume of the suction air into the suction pipe. Thus, it is possible to prevent the opening and closing of the vacuum valve due to the temporal fluctuation of the pressure difference between two points in the suction pipe which are different in height and control the volume of the suction air through the vacuum valve.

Further, the present invention is characterized in that a second diaphragm is provided on the shaft, a sensor pipe is provided for converting the rise of soil water level within a soil water basin into a pressure, a pressurized chamber is provided for applying a pressure on one side of the second diaphragm to shift the shaft in the direction for opening the vacuum valve, and a pressure generated in the sensor pipe is transmitted to the pressurized chamber.

Also, in the vacuum valve controlling device of the invention, a magnet is provided for attracting the shaft in a direction for closing the vacuum valve. Thus, when the pressure generated in the pressure sensor pipe is applied to the second diaphragm and the shaft shifts in a direction for opening the vacuum valve departing from the influence of the attracting force of the magnet, then the shaft rapidly shifts to the shift end or valve opening position against the increasing biasing force of the spring means and, therefore, a rapid and stable opening and closing operation of the vacuum valve can be obtained.

The above and other objects, features and advantages of the present invention will become more apparent from the following description when taken in conjunction with the accompanying drawings in which a preferred embodiment of the present invention is shown by way of illustrative examples.

PREFERRED EMBODIMENT OF THE INVENTION

Figure 1:
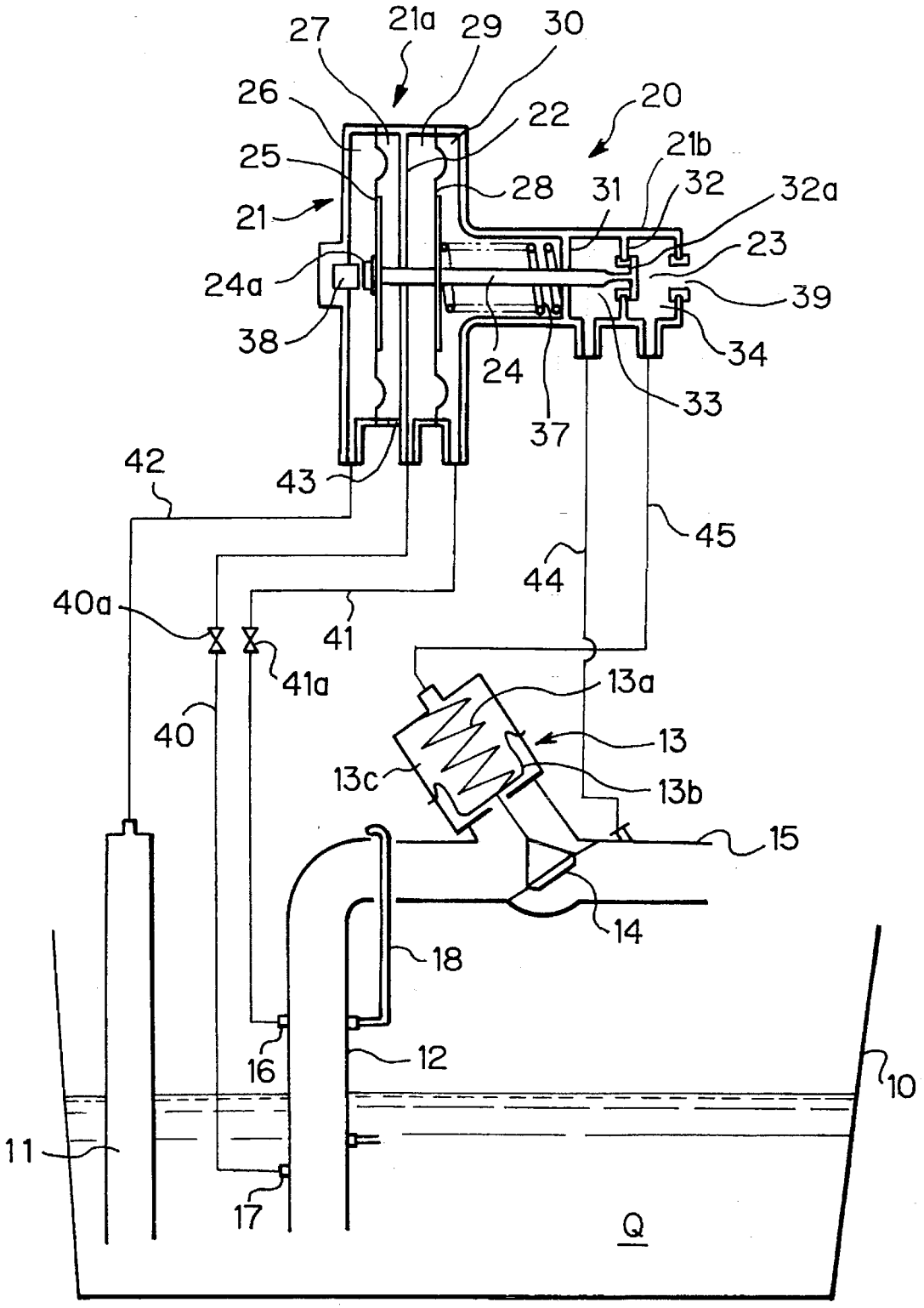
FIG. 1 shows the arrangement of a vacuum sewer system that employs the vacuum valve controller according to an embodiment of the present invention.
Figure 2:
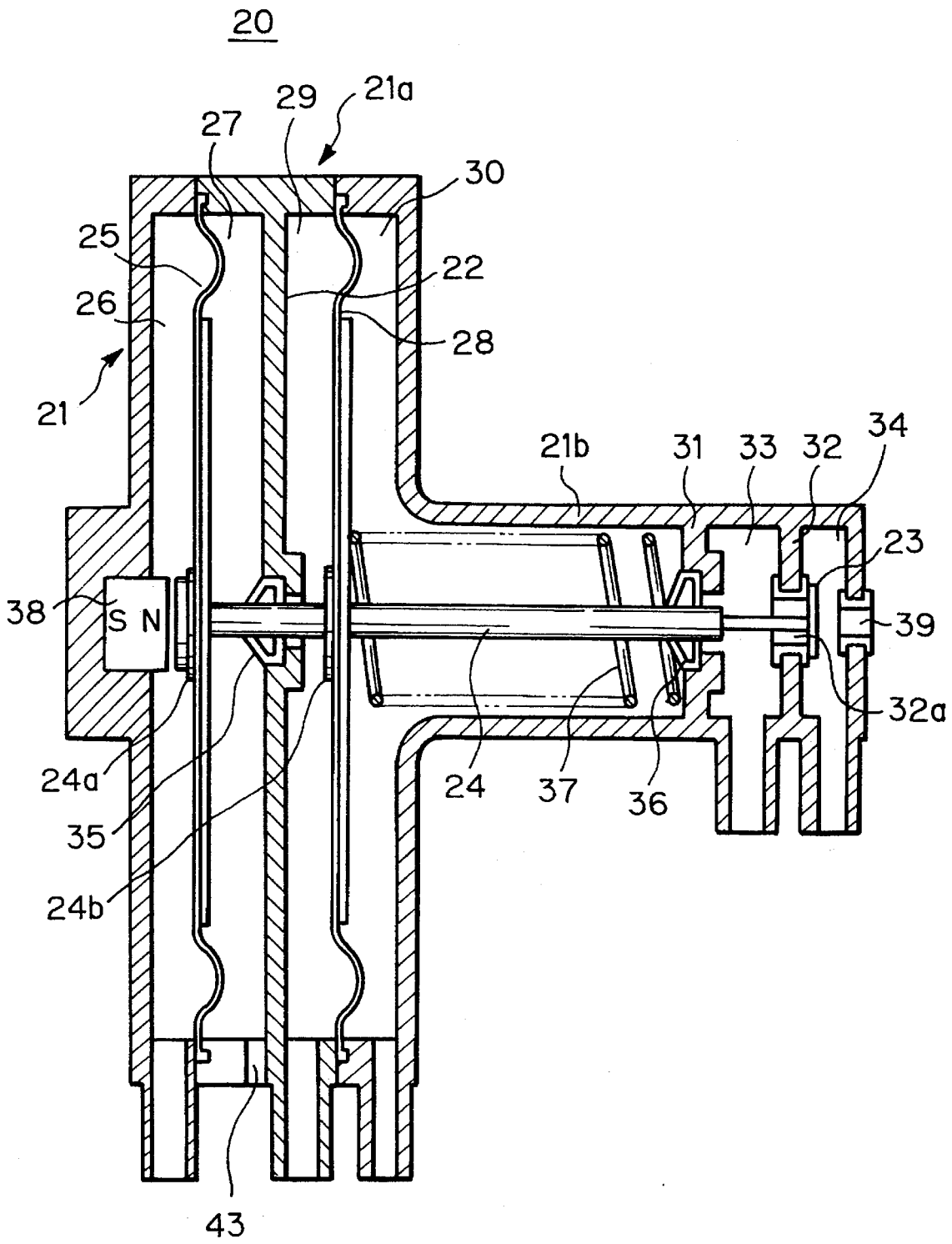
FIG. 2 is an enlarged sectional view of the arrangement of the vacuum valve controller shown in FIG. 1.
Figure 5:
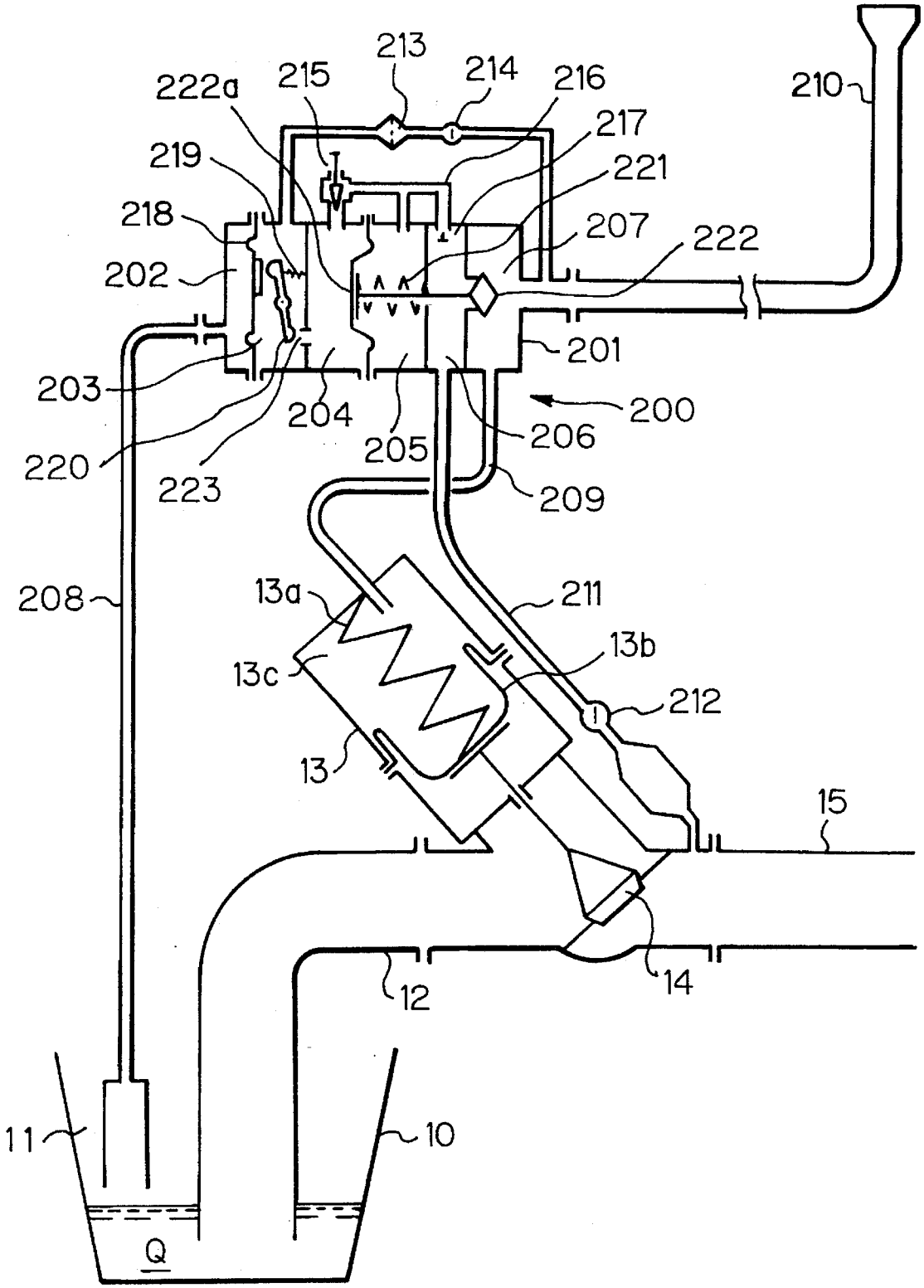
Fig. 5 PRIOR ART
FIG. 5 shows one example of the arrangement of a conventional vacuum sewer system.

An embodiment of the present invention will be described below with reference to the accompanying drawings. FIG. 1 shows the arrangement of a vacuum sewer system which employs the vacuum valve controller of the present invention, and FIG. 2 shows the detailed arrangement of the vacuum valve controller. In FIG. 1, portions which are denoted by the same reference numerals as those in FIG. 5 are the same or corresponding portions. In FIG. 1, reference numeral 18 denotes a simultaneous air suction pipe arranged to suck air simultaneously with the suction of soil water through the suction pipe 12.

A controller 20 has a casing 21. The casing 21 has an integral structure composed of a large-diameter portion 21*a* and a small-diameter portion 21*b*. The large-diameter portion 21*a* has a partition 22 in the center thereof to divide the inside of the large-diameter portion 21*a* into left- and right-hand chambers. The partition 22 is pierced with a shaft 24 of a valve body 23. The left-hand chamber is divided into first and second chambers 26 and 27 by a second diaphragm 25 which is provided in the center thereof. The right-hand chamber is divided into third and fourth chambers 29 and 30 by a first diaphragm 28 which is provided in the center thereof. The inside of the small-diameter portion 21*b* is divided into left- and right-hand chambers by a partition 31. The left-hand chamber communicates with the fourth chamber 30. The right-hand chamber is divided into fifth and sixth chambers 33 and 34 by a partition 32.

The valve body 23, which is secured to the forward end of the shaft 24, is disposed in the sixth chamber 34. The rear end of the shaft 24 is secured to the center of the second diaphragm 25 by means of a set screw 24*a*. The shaft 24 penetrates through the partition 22 and extends through the first diaphragm 28 (it should be noted that the first diaphragm 28 is secured to the shaft 24 by means of a set screw 24*b*). The shaft 24 further penetrates through the partitions 31 and 32. The portion of the partition 22 through which the shaft 24 penetrates is provided with a seal mechanism 35. Similarly, the portion of the partition 31 through which the shaft 24 penetrates is provided with a seal mechanism 36. The portion of the partition 32 through which the shaft 24 penetrates is provided with a throughhole 32*a* which is opened or closed by the valve body 23. Reference numeral 37 denotes a spring that presses the first diaphragm 28 leftward.

A magnet 38 is provided at a position on the rear end wall of the casing 21 which faces the rear end of the shaft 24, i.e., the set screw 24*a* made of a magnetic material. The sixth chamber 34 is provided with a hole 39 which is opened or closed by the valve body 23 and which communicates with the atmospheric air. The suction pipe 12 is provided with pressure detecting holes 16 and 17 with a predetermined spacing provided therebetween in the vertical direction. The pressure detecting hole 16 communicates with the fourth chamber 30 through a pipe 41. The pressure detecting hole 17 communicates with the third chamber 29 through a pipe 40. The pressure sensor pipe 11 communicates with the first chamber 26 through a pipe 42. The second chamber 27 communicates with the atmospheric air through a hole 43. The fifth chamber 33 communicates with the line 15 through a pipe 44. The sixth chamber 34 communicates with the chamber 13*c* in the vacuum valve body 13.

In the vacuum sewer system that employs the vacuum valve controller arranged as described above, when the level of soil water in the soil water basin 10 rises, and consequently the pressure detected by the pressure sensor pipe 11 rises, the pressure is transmitted to the first chamber 26 in the controller 20 through the pipe 42. Thus, the second diaphragm 25 moves rightward against the sum of the biasing force of the spring 37 and the magnetic attracting force of the magnet 38, pressing the shaft 24, and hence the valve body 23 closes the hole 39, which communicates with the atmospheric air. Consequently, the vacuum in the line 15 is transmitted to both the fifth and sixth chambers 33 and 34 through the pipe 44 and further transmitted to the chamber 13*c* in the vacuum valve body 13. Thus, the main valve 14 is pulled up.

When the second diaphragm 25 is pushed rightward by the pressure transmitted from the pressure sensor pipe 11, although the biasing force of the spring 37 increases with the shift of the shaft 24, since the magnetic attracting force of the magnet 38 decreases rapidly (at the inverse square of the shift volume), the shaft 24 immediately shifts to the shift end, i.e., the position where the valve body 23 closes the opening 39. The fifth chamber 33, the sixth chamber 34 and the valve body 23 constitute a vacuum valve on/off control mechanism for opening and closing the vacuum valve 13.

When the main valve 14 is pulled up, the line 15 and the suction pipe 12 are communicated with each other. Consequently, soil water begins to be sucked, and a pressure difference is produced between the pressure detecting holes 16 and 17 and transmitted to the fourth and third chambers 30 and 29 through the respective pipes 41 and 40. The differential pressure pushes the first diaphragm 28 rightward, causing the valve body 23 to be further pressed rightward through the shaft 24. Even when the soil water level falls to such an extent that there is no pressure difference between the first and second chambers 26 and 27, the valve body 23 remains pressed rightward by the action of the pressure difference between the fourth and third chambers 30 and 29.

When the soil water level further falls to such an extent that air is sucked from the lower end of the suction pipe 12, there is no pressure difference between the pressure detecting holes 16 and 17. Consequently, the first diaphragm 28 is pressed leftward by the spring 37. Thus, the valve body 23 is pressed leftward to close the through-hole 32*a* of the partition 32. As a result, atmospheric air flows into the sixth chamber 34. The atmospheric air flows into the chamber 13*c* in the vacuum valve body 13 through the pipe 45, thereby allowing the main valve 14, which constantly pressed by the spring 13*a*, to close the bore which provides communication between the suction pipe 12 and the line 15. Thus, the communication between the suction pipe 12 and the line 15 is cut off.

In actual practice, when the main valve 14 is opened, soil water Q begins to be sucked through the suction pipe 12, and at the same time, air is also sucked through the air suction pipe 18. Thus, a sufficient amount of air is sucked in the line 15 through the suction pipe 12 which increases the air-liquid ratio in the line and prevents the occurrence of an air lock in the piping.

Figure 3A:
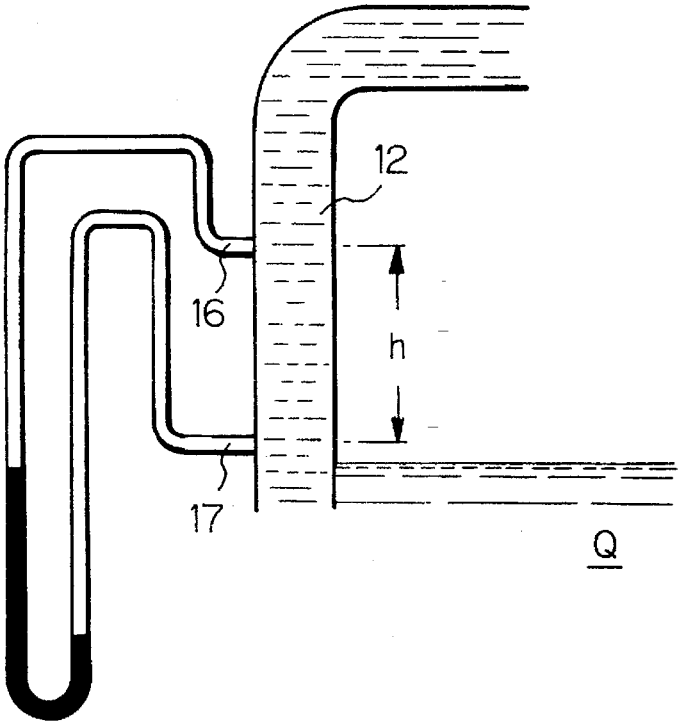
FIGS. 3(*a*) and 3(*b*) show the way in which the pressure difference between pressure detecting holes in a suction pipe of the controller, which are different in height from each other, changes.
Figure 3B:
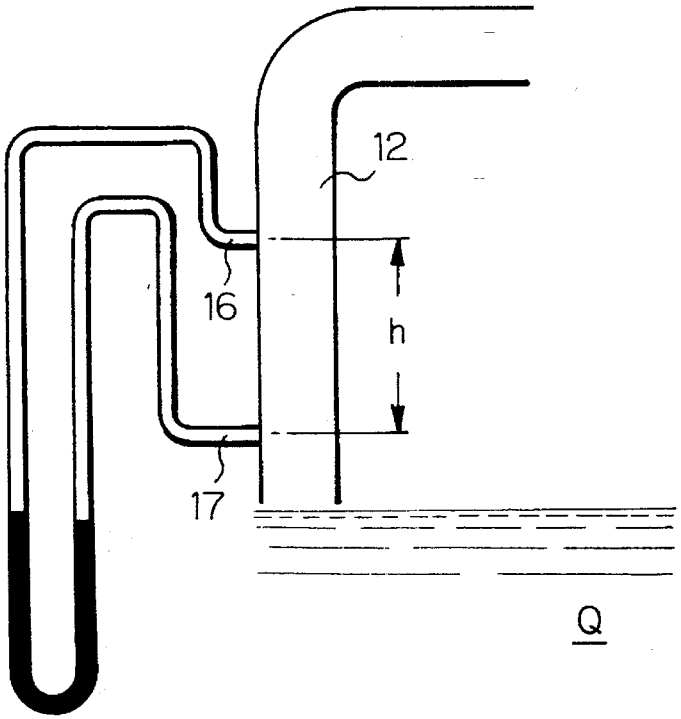

FIGS. 3(*a*) and 3(*b*) show the way in which the pressure difference between the pressure detecting holes 16 and 17 of the suction pipe 12, which are different in height from each other, changes. FIG. 3(*a*) shows the pressure difference during the suction of soil water. FIG. 3(*b*) shows the pressure difference during the suction of air. During the suction of soil water, the pressure difference is large, i.e., $\alpha_1 \times h$; while during the suction of air, the pressure difference is exceedingly small, i.e., $\alpha_2 \times h$. Here, the symbol h represents the dimension between the pressure detecting holes 16 and 17, $\alpha_1$ the specific weight of the soil water and $\alpha_2$ the specific weight of air. Accordingly, the pressure difference is applied between the third and fourth chambers 29 and 30 as follows: During the suction of soil water, the diaphragm 28 is pushed rightward with the differential pressure of $\alpha_1 \times h$; while during the suction of air, the pressure difference between the third and fourth chambers 29 and 30 is substantially zero. Thus, by detecting a point at which the pressure difference has become exceedingly small, it is possible to find that the level of soil water Q has reached the lower end of the suction pipe 12, that is, the level at which air begins to be sucked.

As shown, fluid restrictions 40*a* and 41*a* are respectively provided in the pipe 40 connecting the pressure detecting hole 17 and the third chamber 29 and the pipe 41 connecting the pressure detecting hole 16 and the fourth chamber 30. These fluid restrictions 40*a* and 41*a* prevent reciprocation of the shaft 24 in a short period due to the temporal fluctuation of the pressure difference between the pressure detecting holes 17 and 16 and delay the movement of the first diaphragm 28, thereby providing a function to control the volume of suction air through the vacuum valve. Thus, the vacuum valve 13 does not open or close in response to the temporal fluctuation of the pressure difference between the pressure detecting holes 17 and 16 which stabilizes the operation of the vacuum valve.

Figure 4:
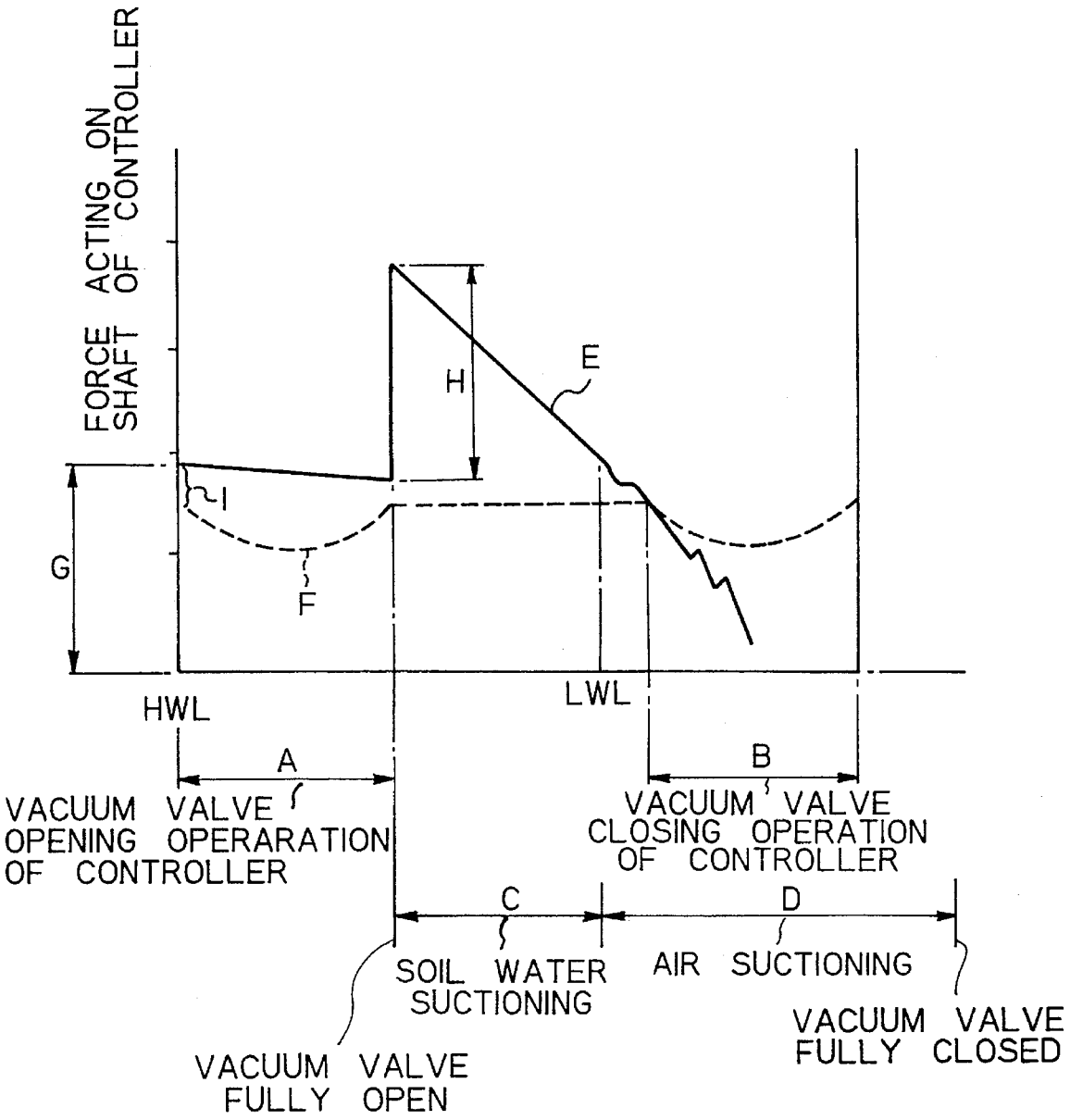
FIG. 4 is a graph showing a relationship between a force acting on the shaft of the controller and the operational timing of the controller.

FIG. 4 shows the relationship between the force applied to the shaft of the controller and the operational timing of the controller, wherein the abscissa denotes the timing of the controller and the ordinate denotes the force applied to the shaft. In the figure, a solid line E denotes the force acting to shift the shaft 24 rightward (vacuum valve opening direction) and the dot line F denotes the force (sum of the biasing force of the spring 37 and the magnetic attracting force of the magnet 38) acting to shift the shaft 24 leftward (vacuum valve closing direction). G denotes the set value for actuating the controller 20, H the pressure difference between the pressure detecting holes 17 and 16 during the suction of the soil water into the suction pipe 12, and I the friction force caused in the seal mechanisms 35 and 36.

The pressure detected in the pressure sensor pipe 11 is transmitted to the first chamber 26 which pushes the second diaphragm 25 of the controller 20 rightward. When the soil water level in the soil water basin 10 reaches a predetermined level (HWL), the pressure transmitted to the first chamber overcomes the sum of the biasing force of the spring 37 and the magnetic attracting force of the magnet 38 and, consequently the shaft 24 is shifted rightward (vacuum valve opening direction) until the valve body 23 closes the hole 39. Then, the relationship between the force E and the force F is E>F and, therefore, the controller is brought under the vacuum valve opening operation A. When the valve body 23 closes the hole 39, the main valve 14 of the vacuum valve 13 is opened as stated above and the soil water Q within the soil water basin 10 is sucked into the suction pipe 12 and, thus the soil water level in the soil water basin begins to lower. When the soil water level lowers to the lower end of the suction pipe (LWL), air is sucked into the suction pipe 12. As the air is sucked into the suction pipe, the pressure difference between the pressure detecting holes 17 and 16 becomes substantially zero and the relationship between the force E and the force F becomes E<F. Thus, the controller is shifted to vacuum valve closing operation B, causing the shaft to shift leftward (the vacuum valve closing direction).

With the above-described arrangement of the controller 20, the fact that the level of soil water has fallen to such an extent that air begins to be sucked from the lower end of the suction pipe 12 is detected from the fact that there is no pressure difference between the pressure detecting holes 16 and 17, and the main valve 14 of the vacuum valve is closed to cut off the communication between the suction pipe 12 and the line 15. Accordingly, there is no possibility that the closing of the vacuum valve is extremely delayed. Also, there is no possibility that a large amount of air will be sucked through the suction pipe 12 at one gulp after soil water in the soil water basin 10 has been sucked. Therefore, there is not likelihood that the level of water used, for example, in a domestic flush toilet would fall to an undesirable level, thereby causing the trap to be destroyed.

With the above-described arrangement of the controller 20, since no vacuum is used as force for activating the vacuum valve controller as in the conventional controller, the controller 20 is free from the above-described conventional problems arising from the use of a vacuum. Since the operation is independent of the degree of vacuum, a stable operation can be obtained.

Although in the foregoing embodiment a soil water level at which the suction pipe 12 begins to suck air is detected from a change of the pressure difference between the pressure detecting holes 16 and 17 of the suction pipe 12 which are different in height from each other, it should be noted that the device for detecting the fact that air begins to be sucked is not necessarily limited to the described arrangement.

As has been described above, the present invention provides the following advantageous effects:

(1) Since the vacuum valve is closed when the detecting device detects that the suction pipe has begun to suck air, the present invention is free from the problem that the amount of air sucked varies according to the degree of vacuum.

(2) Since the detecting device closes the vacuum valve by detecting that the suction pipe has begun to suck air from a change of the pressure difference between two points in the suction pipe which are different in height from each other, the structure is simple and the number of components is small in contrast to the conventional controller that uses a vacuum. Accordingly, maintenance is facilitated.

What is claimed is:

1. A vacuum valve controller for a vacuum sewer system having a suction pipe which is communicated with a vacuum system by opening a vacuum valve, and which is cut off from the vacuum system by closing said vacuum valve so that soil water in a soil water basin is sucked through said suction pipe and sent to a predetermined place by opening said vacuum valve, said vacuum valve controller comprising:

means for detecting that said suction pipe begins to suck air from a lower end thereof when the soil water level has fallen as a result of suction of soil water through said suction pipe; and control means for closing said vacuum valve when said detecting means detects that said suction pipe has begun to suck air, wherein said detecting means detects that said suction pipe begins to suck air from a change of pressure difference between two points in said suction pipe which are different in height from each other.

2. A vacuum valve controller for a vacuum sewer system according to claim 1, wherein said controller includes a pressure sensor pipe for converting the rising of said soil water within said soil water basin into a pressure and transmitting said pressure to said control means, said control means opens said vacuum valve by means of said pressure when said soil water level within said soil water basin reaches a predetermined height.

3. A vacuum valve controller for a vacuum sewer system according to claim 1, wherein said pressure difference between two points in said suction pipe is transmitted to said control means, said control means holds said vacuum valve being open by means of said pressure difference applied to said control means.

4. A vacuum valve controller for a vacuum sewer system according to any one of claims 1, 2 or 3, wherein said controller includes a vacuum valve on/off control mechanism for opening and closing said vacuum valve, said vacuum valve on/off control mechanism includes a shaft reciprocably provided within a casing and a valve body provided on said shaft, said valve body is shiftable between a first position where an actuating chamber of said vacuum valve is communicated with a line of said vacuum system for opening said vacuum valve and a second position where said actuating chamber is opened to atmospheric air for closing said vacuum valve.

5. A vacuum valve controller for a vacuum sewer system according to any one of claims 1, 2 or 3, wherein said control means comprises a vacuum valve on/off control mechanism for opening and closing said vacuum valve, a reciprocating shaft for operating said vacuum valve on/off control mechanism, first and second diaphragms attached to said shaft, a spring means for biasing said shaft in the normal direction for closing said vacuum valve, pressurized chambers for applying pressure on both sides of said first diaphragm, a pressurized chamber for applying a pressure on one side of said second diaphragm to shift said shaft in a direction for opening said vacuum valve, and a pressure sensor pipe for converting the rising of said soil water level in said soil water basin into a pressure, wherein soil water pressure in said suction pipe at two points different in height is transmitted to said pressurized chambers on both sides of said first diaphragm so that a pressure difference thereof operates to shift said shaft against said spring means in a direction for opening said valve, and a pressure generated in said pressure sensor pipe is transmitted to said pressurized chamber on one side of said second diaphragm.

6. A vacuum valve controller for a vacuum sewer system according to claim 5, wherein fluid restrictions are provided in each of the pipes connecting said suction pipe and the control means for transmitting said soil water pressure to said pressurized chambers on both sides of said first diaphragm, whereby reciprocation of said shaft within a short period due to temporal fluctuation of said pressure difference between said two different points in said suction pipe is prevented and the movement of said first diaphragm is delayed to thereby control volume of suction air through said vacuum valve.

7. A vacuum valve controller for a vacuum sewer system according to claim 6, wherein a magnet is provided for attracting said shaft in a direction for closing said vacuum valve.

8. A vacuum valve controller for a vacuum sewer system according to claim 6, wherein an air suction pipe is provided in said suction pipe for suctioning air through said suction pipe when the soil water is being sucked through said suction pipe.

9. A vacuum valve controller for a vacuum sewer system according to claim 5, wherein a magnet is provided for attracting said shaft in a direction for closing said vacuum valve.

10. A vacuum valve controller for a vacuum sewer system according to claim 9, wherein an air suction pipe is provided in said suction pipe for suctioning air through said suction pipe when the soil water is being sucked through said suction pipe.

11. A vacuum valve controller for a vacuum sewer system according to claim 5, wherein an air suction pipe is provided in said suction pipe for suctioning air through said suction pipe when the soil water is being sucked through said suction pipe.

* * * * *